US011007777B2

(12) United States Patent
Hayashi et al.

(10) Patent No.: US 11,007,777 B2
(45) Date of Patent: May 18, 2021

(54) PRINTER

(71) Applicant: FUNAI ELECTRIC CO., LTD., Osaka (JP)

(72) Inventors: Akira Hayashi, Osaka (JP); Masaaki Takagi, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 16/656,588

(22) Filed: Oct. 18, 2019

(65) Prior Publication Data

US 2020/0207080 A1 Jul. 2, 2020

(30) Foreign Application Priority Data

Dec. 26, 2018 (JP) ..... JP2018-243347

(51) Int. Cl.

| | |
|---|---|
| ***B41J 29/02*** | (2006.01) |
| ***A45D 29/00*** | (2006.01) |
| ***B41J 2/045*** | (2006.01) |
| *B41J 3/407* | (2006.01) |
| *A45D 29/22* | (2006.01) |

(52) U.S. Cl.

CPC ..... *B41J 2/04556* (2013.01); *A45D 29/00* (2013.01); *B41J 2/04505* (2013.01); *B41J 29/02* (2013.01); *A45D 29/22* (2013.01); *A45D 2029/005* (2013.01); *B41J 3/4073* (2013.01)

(58) Field of Classification Search

CPC .. B41J 2/04556; B41J 2/04505; B41J 3/4073; B41J 29/02; A45D 29/00; A45D 2029/005; A45D 29/22

See application file for complete search history.

(56) References Cited

U.S. PATENT DOCUMENTS

2016/0088197 A1* 3/2016 Yamasaki ..... H04N 5/23229 132/73.6

2016/0182867 A1* 6/2016 Nagao ..... G06K 9/4604 348/77

FOREIGN PATENT DOCUMENTS

JP 2016123475 7/2016

* cited by examiner

*Primary Examiner* — Yaovi M Ameh

(74) *Attorney, Agent, or Firm* — JCIPRNET

(57) ABSTRACT

A printer is provided to includes an ink head; a placement unit; a positional reference arranged near the placement unit as a reference for performing position adjustment in the up-down direction; and a first reflection member configured to be disposed at a lateral position separated from the placement unit toward a lateral side so that a position of the first reflection member in the up-down direction overlaps the positional reference and the printing target in a lateral view, wherein the first reflection member reflects light arriving from a lateral surface of the printing target and the positional reference, and an upper end of a reflective surface which reflects light is positioned above the positional reference and a lower end is positioned below the positional reference.

20 Claims, 7 Drawing Sheets

PRINTER

CROSS REFERENCE TO RELATED APPLICATIONS

This application claims the priority benefit of Japanese Patent Application No. 2018-243347, filed on Dec. 26, 2018. The entirety of the above-mentioned patent application is hereby incorporated by reference herein and made a part of this specification.

BACKGROUND OF THE DISCLOSURE

Technical Field

The disclosure relates to a printer.

Related Art

Conventionally, a printer is known (for example, see Patent literature 1: Japanese Patent Application Laid-open No. 2016-123475).

Patent literature 1 discloses a print apparatus (printer) including an inkjet print head that performs printing on a fingernail, a finger inserting unit into which a finger is inserted, an opening portion arranged above the finger inserting unit, a laser irradiating unit that performs irradiation with a laser beam toward an edge of the opening portion, a mirror that reflects the laser beam, an imaging unit that is arranged above the opening portion and images a position of the finger inserted into the finger inserting unit, and a determination unit that determines the position of the finger in the finger inserting unit based on an imaging result of the imaging unit. In the print apparatus disclosed in Patent literature 1, the mirror is configured to horizontally reflect the laser beam at a predetermined height position. In addition, the determination unit determines whether the fingernail is located at a correct position of a horizontal position based on the imaging result captured from above the opening portion. In addition, when a color of the finger or nail changes into a color of the laser beam based on the imaging result captured from above the opening portion, the determination unit determines that the laser beam reaches the finger or nail, and the fingernail is located above the predetermined height position. When the color of the finger or nail does not change into the color of the laser beam, the determination unit determines that the laser beam does not reach the finger or nail, and the fingernail is located below the predetermined height position.

In the print apparatus disclosed in Patent literature 1, the determination unit determines whether the fingernail is located at the correct position of the horizontal position in the finger inserting unit based on the imaging result captured from above the opening portion, and thus the fingernail can be easily guided to the correct position in a horizontal direction. However, regarding a height position of the nail, the determination unit determines only whether the height position of the fingernail is higher or lower than the predetermined height position. As a result, it is not possible to visually recognize or image the height position of the nail and the predetermined height position to compare the positions, and it is not possible to check a distance between the height position of the nail and the predetermined height position. Therefore, it may be inconvenient to know how much the finger should be moved in an up-down direction to place the nail at the predetermined height position. As a result, it is not easy to perform position adjustment of the fingernail (printing target).

The embodiments of the disclosure provide a printer in which position adjustment of a printing target can be easily performed in a horizontal direction and an up-down direction.

SUMMARY

According to one embodiment of the disclosure, a printer is provided to include: an ink head that is configured to be movable in a horizontal direction and applies ink on a printing target; a placement unit at which the printing target is placed; a positional reference that is arranged near the placement unit and is used as a reference for performing position adjustment of the printing target in an up-down direction; and a first reflection member configured to be disposed at a lateral position separated from the placement unit toward a lateral side so that a position of the first reflection member in the up-down direction overlaps the positional reference and the printing target in a lateral view, wherein the first reflection member reflects light arriving from a lateral surface of the printing target and the positional reference, and an upper end of a reflective surface which reflects light is positioned above the positional reference and a lower end is positioned below the positional reference, or the first reflection member configured to be disposed at an upper position separated from the placement unit toward an upper side so that a position of the first reflection member in the horizontal direction overlaps the printing target in a plan view, wherein the first reflection member reflects light arriving from a top surface of the printing target.

DESCRIPTION OF THE EMBODIMENTS

Hereinafter, embodiments of the disclosure are described with reference to the drawings.

First Embodiment

A configuration according to the first embodiment of the disclosure is described with reference to FIGS. 1-4.

Figure 1:
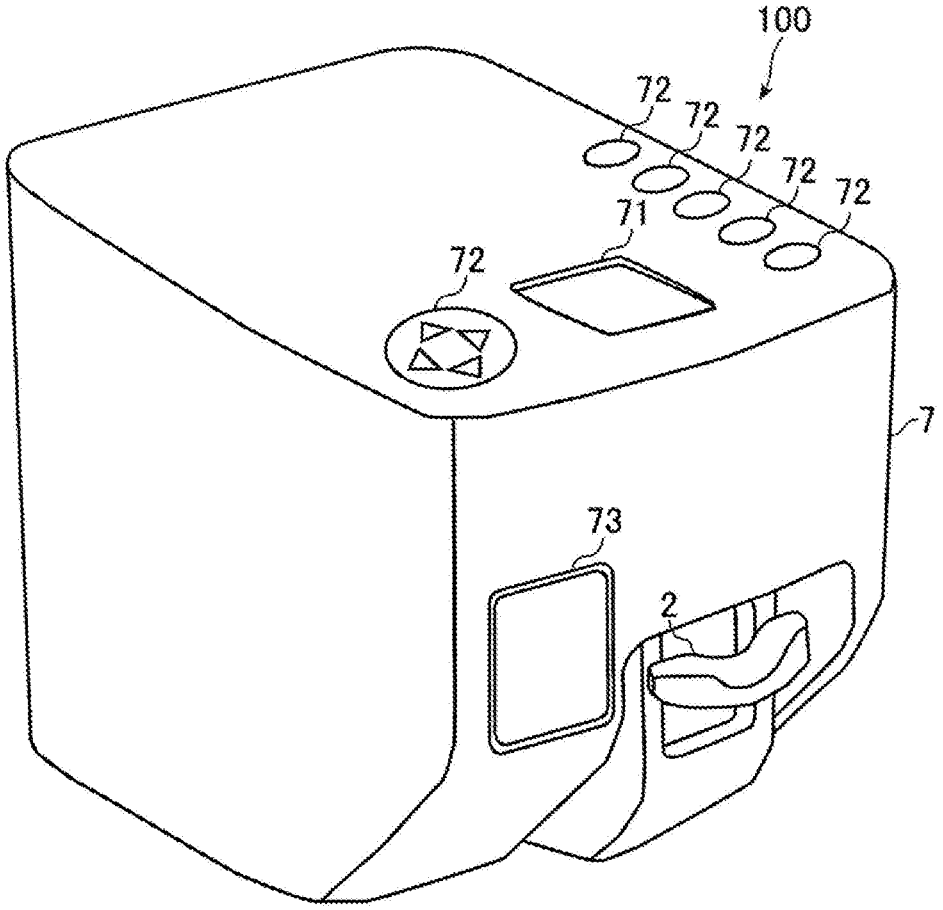
FIG. 1 is an external view of a printer according to a first embodiment.

As illustrated in FIG. 1, a housing 7 of a printer 100 has a window portion 71, an operation unit 72, and a maintenance door 73. In addition, a hole through which a finger is inserted into the housing 7 is arranged in the housing 7. A user inserts a finger from the hole arranged in the housing 7 and places the finger at a placement unit 2 arranged for the finger to be placed.

The window portion 71 is a window arranged in the housing 7 to visually recognize an inserted fingernail 200 from above. The window portion 71 is an opening arranged in the housing 7. A transparent member may be arranged in the opening. Moreover, the finger 200 is an example of a "printing target" in the claims.

The operation unit 72 is a physical button arranged at the housing 7 for performing operations such as an operation for selecting an image, a design, or the like to be printed or an operation for a printing start.

The maintenance door 73 is an openable/closable door arranged in the housing 7 for maintenance of a first mirror 4 and a second mirror 5 shown in FIG. 2 and described later. In some cases, ink is adhered to reflective surfaces of the first mirror 4 and the second mirror 5 during performing printing on the fingernail 200, or dirt is adhered to the reflective surfaces. Therefore, in order to maintain visual recognition, it is necessary to perform maintenance work such as work of cleaning the reflective surfaces of the first mirror 4 and the second mirror 5 or work of replacing the first mirror 4 and the second mirror 5. The maintenance door 73 is configured to be openable and closable so that the maintenance work can be performed.

Figure 2:
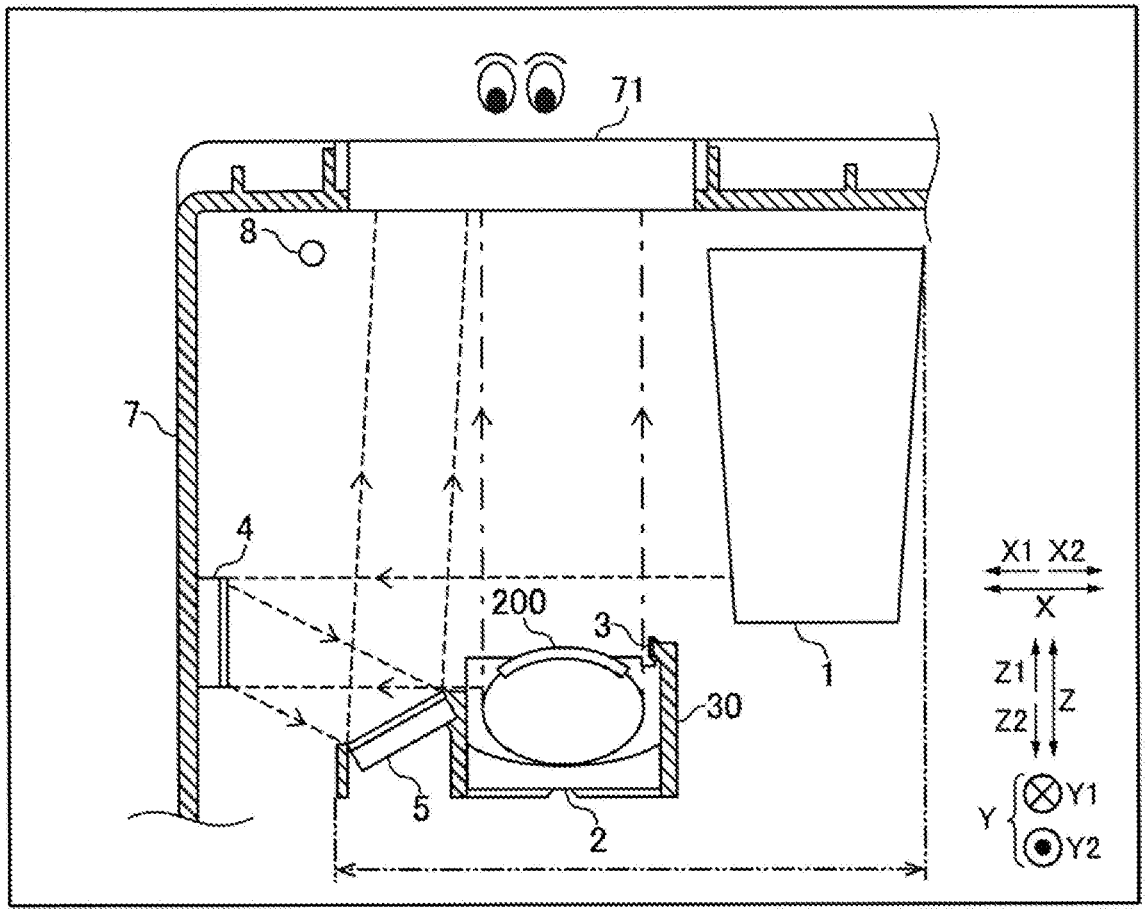
FIG. 2 is a view illustrating arrangement of a first mirror and a second mirror inside the printer according to the first embodiment.

FIG. 2 illustrates an arrangement of an ink head 1, the placement unit 2, a restriction member 30, a positional reference 3, the first mirror 4, the second mirror 5, an illumination unit 8, the window portion 71, and the fingernail 200 inside the housing 7 according to the first embodiment. Moreover, the first mirror 4 is an example of a "first reflection member" in the claims, and the second mirror 5 is an example of a "second reflection member" in the claims.

The ink head 1 applies ink on a surface of the fingernail 200 being the printing target, thereby performing nail printing of printing an image, a design, or the like. The ink head 1 is movable in a horizontal direction (XY direction) by a movement mechanism 11 (see FIG. 4). Moreover, the movement mechanism 11 is configured by a motor or the like. When a position adjustment of the fingernail 200 is performed, the ink head 1 is disposed at a position that does not overlap the placement unit 2 or the window portion 71 in a plan view, as illustrated in FIG. 2. In addition, during the printing, the ink head 1 is moved to a position above the fingernail 200 by the movement mechanism 11 and performs the printing on the surface of the fingernail 200.

The fingernail 200 inserted from the hole arranged in the housing 7 is placed at the placement unit 2. The placement unit 2 is configured to be capable of moving in an up-down direction (Z direction) so as to perform the position adjustment of the fingernail 200 in a height direction. In addition, the restriction member 30 is arranged above and at a lateral side of the placement unit 2. The restriction member 30 is a member that restricts upward movement of a finger.

Figure 3:
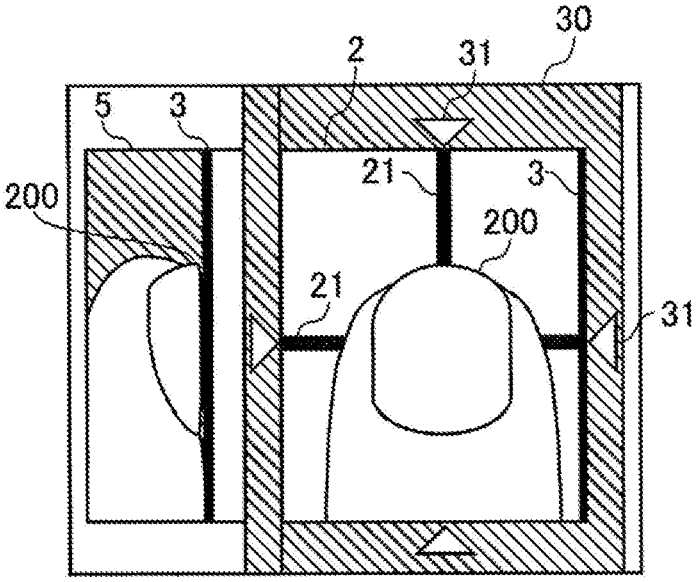
FIG. 3 illustrates an example of a top surface and a lateral surface of a fingernail and a positional reference which are visually recognized from a window portion of the printer according to the first embodiment.

The positional reference 3 is a reference used for performing the position adjustment of the fingernail 200 being the printing target in the up-down direction (Z direction), and may be disposed at a position close to the fingernail 200. In the first embodiment, the positional reference 3 is arranged at the restriction member 30 disposed near the placement unit 2. In addition, as illustrated in FIG. 3, a marker 31 for performing position adjustment of the horizontal direction (XY direction) is also arranged on the restriction member 30 that restricts the upward movement of the finger. The restriction member 30 is a member fixed to the housing 7 or the like and is not moved even when the finger is moved during the position adjustment. In addition, the restriction member 30 is disposed at a position close to the fingernail 200 being the printing target, and thus the restriction member is suitable for arranging a reference and a mark such as the positional reference 3 or the marker 31 used for position adjustment. In addition, in the first embodiment, the positional reference 3 is represented by one reference line; however, the positional reference 3 may not be limited to the reference line. The positional reference 3 is disposed below at least a lower end of the ink head 1 so that the fingernail 200 does not come into contact with the ink head 1. For example, the positional reference 3 may be disposed at a position (for example, 1 mm or more and 3 mm or less downward from the lower end of the ink head 1) at which the printing is most clearly performed on a printing target.

The first mirror 4 is a mirror that reflects, as illustrated by a dashed line in FIG. 2, light arriving from the positional reference 3 and a lateral surface of the fingernail 200 placed at the placement unit 2. That is, the reflective surface of the first mirror 4 is disposed to face a side of the positional reference 3. The first mirror 4 is disposed at a lateral position separated from the placement unit 2 toward a lateral side so that a position of the first mirror 4 in the up-down direction (Z direction) overlaps, in a lateral view, the positional reference 3 and the fingernail 200 placed at the placement unit 2.

Further, the first mirror 4 is configured in a manner that the fingernail 200 being the printing target can be visually recognized even at a lower position that does not overlap the positional reference. Specifically, by increasing a size of the first mirror 4 or adjusting arrangement of the first mirror in the up-down direction, or performing both the increasing and the adjusting, an upper end of the reflective surface that reflects lights is positioned above the positional reference 3 and a lower end of the reflective surface is positioned below the positional reference 3. In addition, the first mirror 4 is disposed at a position that does not overlap a region in which the ink head 1 is movable in a plan view. A region represented by a two-dot chain-lined arrow and a two-dot chain line in FIG. 2 is a movement range of the ink head 1. The first mirror 4 is disposed out of the movement range. When the first mirror is disposed as described above, the size of the first mirror 4 is not limited by a position of the lower end of the ink head 1. Consequently, the first mirror 4 can be increased in size, and thus a range (visually recognizable range) in which the positional reference 3 and the fingernail 200 being the printing target are simultaneously projected can be widened.

The second mirror 5 is a mirror that reflects, toward the window portion 71 at an upper side, the light reflected from the first mirror 4 as illustrated by a dashed line in FIG. 2. That is, the reflective surface of the second mirror 5 is disposed to face a side of the reflective surface of the first mirror 4. The second mirror 5 is disposed at a position below the positional reference 3 in the up-down direction (Z direction). In addition, the second mirror 5 is disposed at a position between the first mirror 4 and the placement unit 2, the position being separated from the placement unit 2 toward the lateral side in the horizontal direction (XY direction).

The first mirror 4 and the second mirror 5 may be configured to be movable or be configured to be detachable for maintenance. In addition, in order to adjust a visual difference in size due to a difference in optical path length between a top view of the fingernail 200 being the printing target and a side view which is projected on the mirror, the first mirror 4 and the second mirror 5 may be a magnifying mirror.

The illumination unit 8 is an illumination such as a white LED installed to illuminate an inside of the housing 7. The illumination unit 8 is turned on and off by controls performed by the control unit 9 described later. Even when the inside of the housing 7 is dark, the illumination unit 8 is turned on, and thereby it is easy to visually recognize the inside of the housing 7.

The window portion 71 is arranged above the housing 7. The window portion 71 is arranged at a position at which a top surface of the fingernail 200 being the printing target is visually recognizable from directly above and at which the reflective surface of the second mirror 5 is visually recognizable. In addition, a magnifying lens may be disposed at a portion of the window portion 71 to which the light reflected from the second mirror 5 is incident. When a magnifying lens is disposed, it is possible to adjust a visual difference due to a difference in optical path length between a side view of the fingernail 200 and the positional reference 3 which are projected on the reflective surface of the second mirror 5 and the top view of the fingernail 200.

FIG. 3 illustrates an example of the top surface of the fingernail 200 which is visually recognized from the window portion 71 arranged at the upper side of the housing 7 and the lateral surface of the fingernail 200 and the positional reference 3 which are projected on the second mirror 5.

By disposing the first mirror 4 and the second mirror 5 as described above, the top surface of the fingernail 200 being the printing target, the lateral surface of the fingernail 200 and the positional reference 3 can be visually recognized simultaneously from above. In addition, a marker 21 arranged at the placement unit 2 and the marker 31 arranged at the restriction member 30 can also be visually recognized simultaneously. The marker 21 and the marker 31 are markers used for performing position adjustment in the horizontal direction (XY direction). Consequently, the marker 21 and the marker 31 used for performing the position adjustment in the horizontal direction (XY direction) and the positional reference 3 which is the reference used for performing position adjustment in the up-down direction (Z direction) can be simultaneously checked simply by visual recognition from above. As a result, the position adjustment of the fingernail 200 being the printing target in the up-down direction (Z direction) and the horizontal direction (XY direction) can be performed simply by the visual recognition from above.

Figure 4:
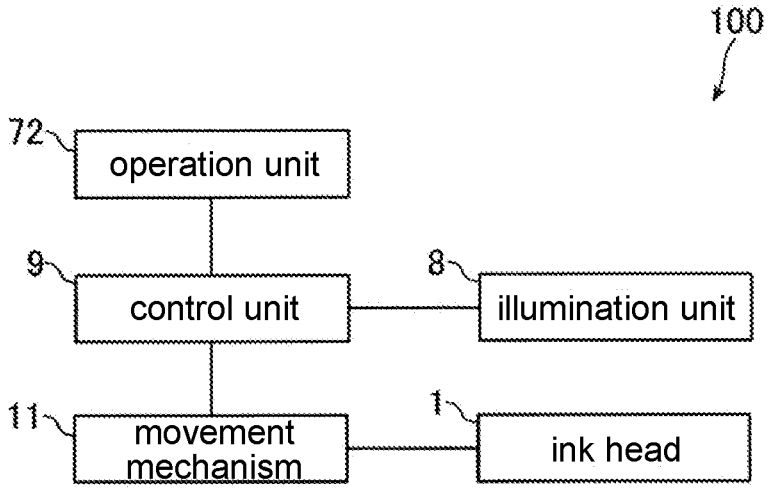
FIG. 4 is a block diagram illustrating a control configuration of the printer according to the first embodiment.

FIG. 4 is a block diagram illustrating a control configuration of the printer 100 according to the first embodiment.

The control unit 9 receives an operation of the operation unit 72 and performs control in response to the operation. In addition, the control unit 9 controls the movement mechanism 11 configured by a motor or the like, thereby moving the ink head 1 in the horizontal direction (XY direction). Further, the control unit 9 controls on and off of the illumination light of the illumination unit 8 based on operations for performing printing on the fingernail 200 being the printing target.

The operation unit 72 is operated to select, from image data, an image to be printed on the fingernail 200, a printing size and the like. The image data is data of an image and design to be printed. The image data is data stored in the printer 100 in advance, data transmitted to the printer 100 from an external terminal via wireless or wired communication, or the like. The control unit 9 receives the operation of the operation unit 72 and prints the selected image at the selected printing size.

After selection of the image and the printing size is completed, the illumination of the illumination unit 8 arranged in the housing 7 is turned on by the control of the control unit 9. Consequently, the illumination light leaks out of the hole of the housing 7, the hole being arranged for the finger to be inserted therethrough, and thus the user can easily recognize that the printer comes into a state in which insertion and the position adjustment of the finger can be performed. Then, the user inserts the finger into the hole of the housing 7 so that the fingernail 200 faces upward, and the user places the finger at the placement unit 2. Thereafter, the user performs position adjustment of the fingernail 200 visually recognized from the window portion 71 with the positional reference 3, the marker 21, and the marker 31 as references. In this case, the user performs the position adjustment of the fingernail 200 by moving the user's finger.

When the position adjustment is completed, the user presses down a button of the operation unit 72 for a printing start. The control unit 9 receives pressing of the button for the printing start and starts the printing on the fingernail 200. First, the control unit 9 controls movement of the movement mechanism 11, thereby moving the ink head 1 to a position above the fingernail 200. Then, the control unit 9 applies ink on a surface of the fingernail 200 while controlling the movement mechanism 11 and the ink head 1 to move the ink head 1 in the horizontal direction (XY direction). When the printing on the fingernail 200 is ended, the control unit 9 moves the ink head 1 to a position that does not overlap the placement unit 2 or the window portion 71 in a plan view. Then, the illumination of the illumination unit 8 arranged in the housing 7 is turned off by the control of the control unit 9. Moreover, after the printing on the fingernail 200 is ended, the process described above is repeated on another finger, and thereby the printing is performed on a plurality of fingernails 200.

Effects of First Embodiment

In the first embodiment, the following effects can be achieved.

In the first embodiment, as described above, the first mirror 4 (first reflection member) is arranged which is disposed at the lateral position separated from the placement unit 2 toward the lateral side so that the position of the first mirror 4 in the up-down direction (Z direction) overlaps the positional reference 3 and the fingernail 200 (printing target) in a lateral view. The first mirror 4 reflects light arriving at the first mirror from the lateral surface of the fingernail 200 and the positional reference 3, and the upper end of the reflective surface which reflects light is positioned above the positional reference 3 and the lower end of the reflective surface is positioned below the positional reference 3. Consequently, by disposing the first mirror 4 at the lateral position, the first mirror 4 reflects light arriving from the lateral surface of the fingernail 200 and the positional reference, and thus the lateral surface of the fingernail 200 and the positional reference can be visually recognized or imaged from a direction of reflection. In addition, by disposing the first mirror 4 at the lateral position, the first mirror 4 is not disposed above the fingernail 200, and thus the top surface of the fingernail 200 can be visually recognized or imaged from above. As a result, the light arriving at the first mirror from the lateral surface of the fingernail 200 and the positional reference is reflected to be upwardly guided, and thereby the top surface and the lateral surface of the fingernail 200 can be visually recognized or imaged simultaneously from above. In addition, by disposing the first mirror 4 in a manner that the position in the up-down direction (Z direction) overlaps the positional reference and the fingernail 200 in a lateral view, the positional reference can be visually recognized or imaged from right in front (right beside). Hence, an error due to parallax is unlikely to occur with respect to the positional reference, and the position adjustment can be easily performed. In addition, by positioning the upper end of the reflective surface of the first mirror 4 that reflects light above the positional reference, and positioning the lower end of the reflective surface below the positional reference, a range in which it is possible to perform visual recognition or imaging by the first mirror 4 can be widened in the up-down direction (Z direction) with the positional reference interposed in the range, and thus the fingernail 200 can be visually recognized or imaged easily even when the fingernail 200 is placed at a position that does not overlap the positional reference. Consequently, when the first mirror 4 is arranged at the lateral position, the position adjustment of the fingernail 200 in the horizontal direction (XY direction) and the up-down direction (Z direction) can be easily performed.

In addition, in the first embodiment, as described above, the first mirror 4 (first reflection member) is disposed at the lateral position, and the first mirror is disposed at a position that does not overlap the region in which the ink head 1 is movable in a plan view. Consequently, the size of the first mirror 4 is not limited by the position of the lower end of the ink head 1 and can be increased. Hence, a range in which the fingernail 200 (printing target) and the positional reference 3 are simultaneously projected is widened. As a result, a range in which it is possible to compare the position of the fingernail 200 and the position of the positional reference 3 is widened, and thus the position adjustment can be performed more easily.

In addition, in the first embodiment, as described above, the first mirror 4 (first reflection member) is disposed at the lateral position, and the second mirror 5 (second reflection member) is arranged which is disposed at the position below the positional reference 3 and the position separated from the placement unit 2 toward the lateral side, the second mirror 5 upwardly reflecting light reflected from the first mirror 4. Consequently, the second mirror 5 is not limited by the arrangement of the ink head 1. Hence, compared with the first mirror 4, the second mirror 5 can be close to the fingernail 200 (printing target), and thus the lateral surface of the fingernail 200 and the positional reference 3 can be visually recognized at a position closer to the fingernail 200. As a result, the top surface and the lateral surface of the fingernail 200 and the positional reference 3 can be visually recognized simultaneously at a smaller viewing angle, and thus the position adjustment can be more easily performed.

In addition, in the first embodiment, as described above, the first mirror 4 (first reflection member) is disposed at the lateral position, and the top surface and the lateral surface of the fingernail 200 (printing target) and the positional reference 3 can be visually recognized from above. Consequently, the position adjustment of the fingernail 200 in the up-down direction (Z direction) and the horizontal direction (XY direction) can be performed by the visual recognition thereof from above. As a result, in the position adjustment in the up-down direction (Z direction) and the horizontal direction (XY direction), compared with a case in which the top surface and the lateral surface of the fingernail 200 (printing target) and the positional reference 3 are visually recognized from both the upper side and the lateral side to perform the position adjustment, a procedure (work burden) for the position adjustment can be suppressed from increasing.

In addition, in the first embodiment, as described above, the printer includes the housing 7 that covers the ink head 1, the placement unit 2, the positional reference 3, and the first mirror 4 (first reflection member), the illumination unit 8 that is arranged in the housing 7 and irradiates the fingernail 200 (printing target) with the illumination light, and the control unit 9 that controls on and off of the illumination light of the illumination unit 8 based on operations for performing the printing on the fingernail 200. Consequently, the user can turn on the illumination light when the selection of a printing image and a printing size is completed, and the printer comes into a state in which the position adjustment of the fingernail 200 can be performed. Hence, when the illumination light is turned on, the illumination light leaks out of the hole of the housing 7, the hole being arranged for the finger to be inserted therethrough. As a result, since it is possible for the user to easily recognize that the printer comes into the state in which the insertion and the position adjustment of the finger can be performed, the insertion and the position adjustment of the finger can be guided, and operability can be improved.

In addition, in the first embodiment, as described above, the printing target to which the light is reflected from the first mirror 4 (first reflection member) is the fingernail 200. According to this configuration, a nail printer can be provided in which the position adjustment of the fingernail 200 in the horizontal direction (XY direction) and the up-down direction (Z direction) can be easily performed through visual recognition of the fingernail from above.

Second Embodiment

Next, the second embodiment is described with reference to FIG. 5. Unlike the first embodiment in which the second mirror 5 (second reflection member) is arranged, in the second embodiment, the light arriving from the lateral surface of the fingernail 200 and the positional reference 3 is upwardly reflected by the first mirror 4 (first reflection member) but not by the second mirror 5 (second reflection member).

Figure 5:
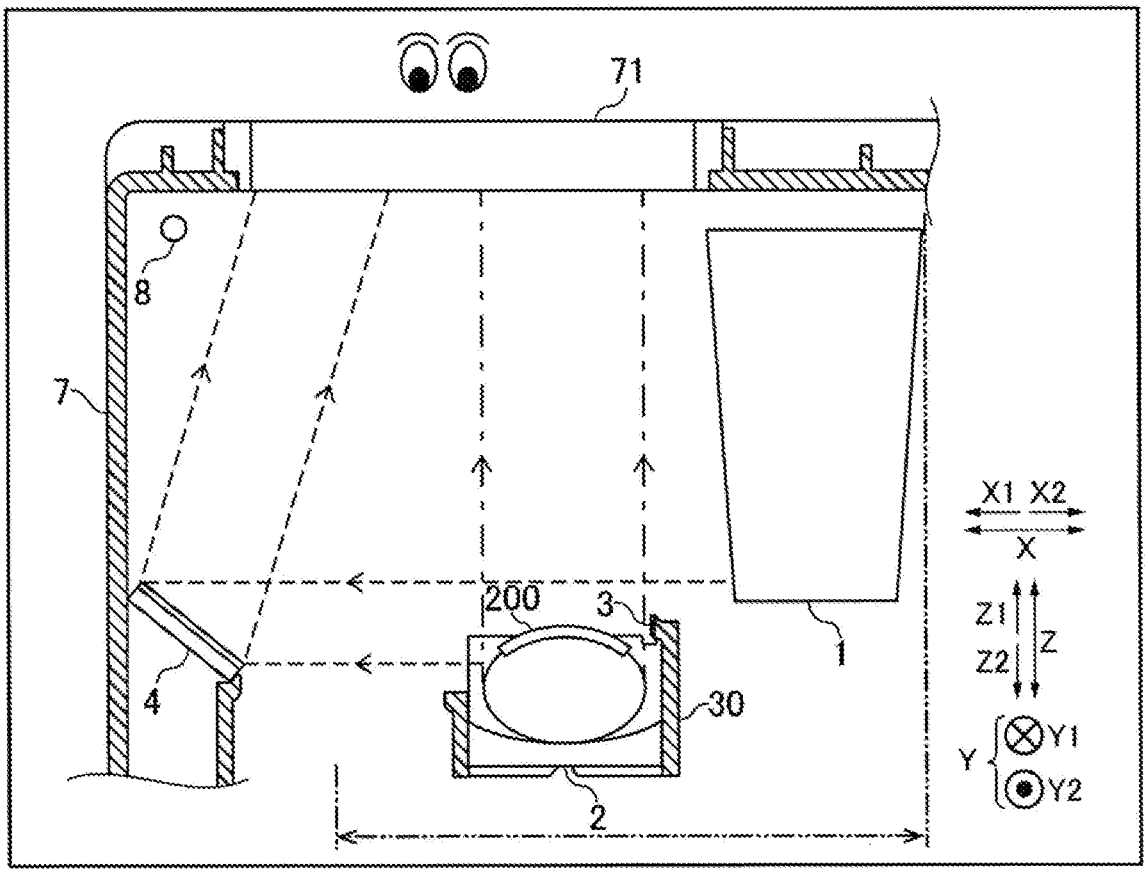
FIG. 5 is a view illustrating arrangement of a first mirror inside a printer according to a second embodiment.

In the second embodiment, as illustrated in FIG. 5, the first mirror 4 upwardly reflects light arriving from the lateral surface of the fingernail 200 and the positional reference 3. In addition, the window portion 71 may be configured to be widened in the X direction so that the light reflected by the first mirror 4 can be visually recognized.

Moreover, other configurations of the second embodiment are the same as those of the first embodiment.

Effects of Second Embodiment

In the second embodiment, the following effects can be achieved.

In the second embodiment, similar to the first embodiment, the first mirror 4 (first reflection member) is arranged that is disposed at the lateral position separated from the placement unit 2 toward the lateral side so that the position of the first mirror in the up-down direction (Z direction) overlaps the positional reference 3 and the fingernail 200 (printing target) in a lateral view. The first mirror 4 reflects light arriving at the first mirror from the lateral surface of the fingernail 200 and the positional reference 3, the upper end of the reflective surface which reflects light is positioned above the positional reference 3 and the lower end of the reflective surface is positioned below the positional reference 3. Consequently, the position adjustment of the fingernail 200 being the printing target in the horizontal direction (XY direction) and the up-down direction (Z direction) can be easily performed.

In addition, in the second embodiment, as described above, the light arriving from the lateral surface of the fingernail 200 and the positional reference is upwardly reflected by the first mirror 4 (first reflection member) but not by the second mirror 5 (second reflection member). Consequently, compared with a case in which the second mirror 5 (second reflection member) is arranged, the number of components can be suppressed from increasing, and apparatus configuration can be suppressed from being complicated.

Moreover, other effects of the second embodiment are the same as those of the first embodiment.

Third Embodiment

Figure 6:
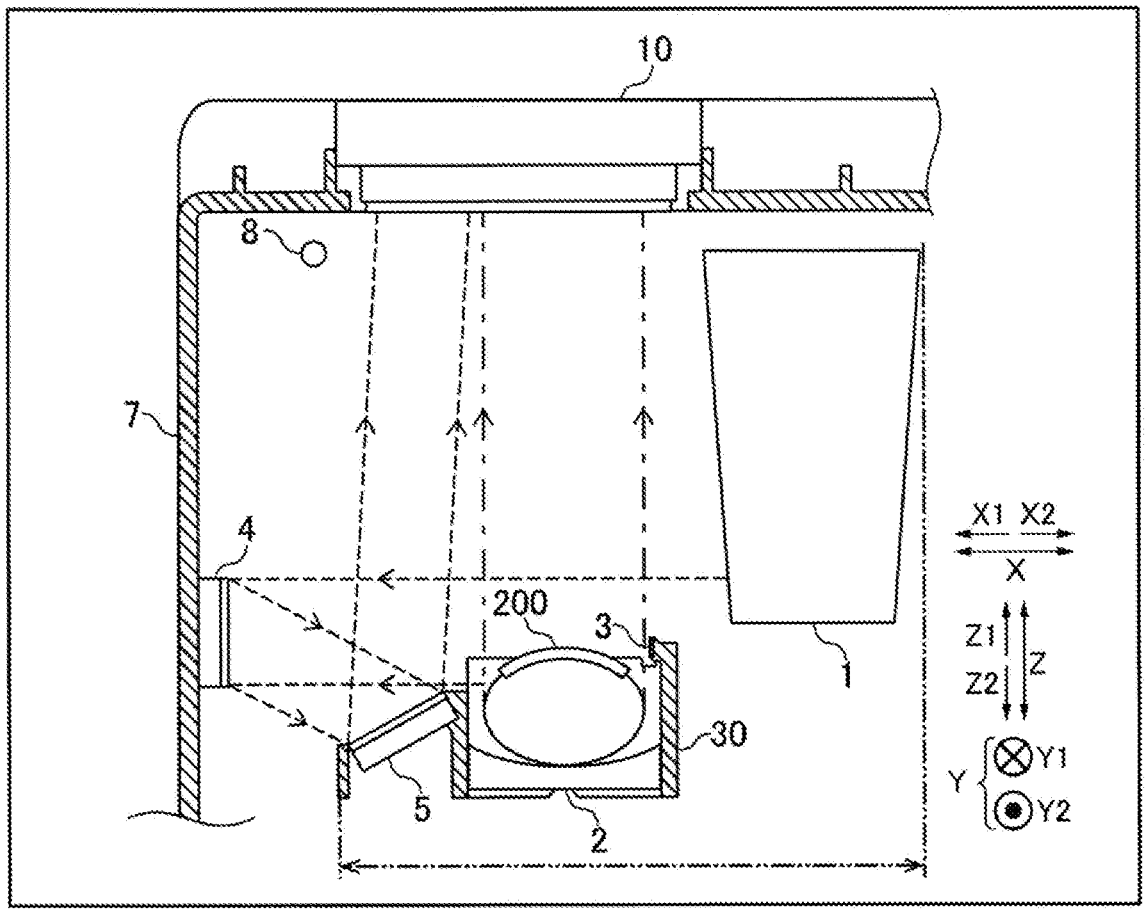
FIG. 6 is a view illustrating arrangement of a first mirror, a second mirror, and a camera inside a printer according to a third embodiment.
Figure 7:
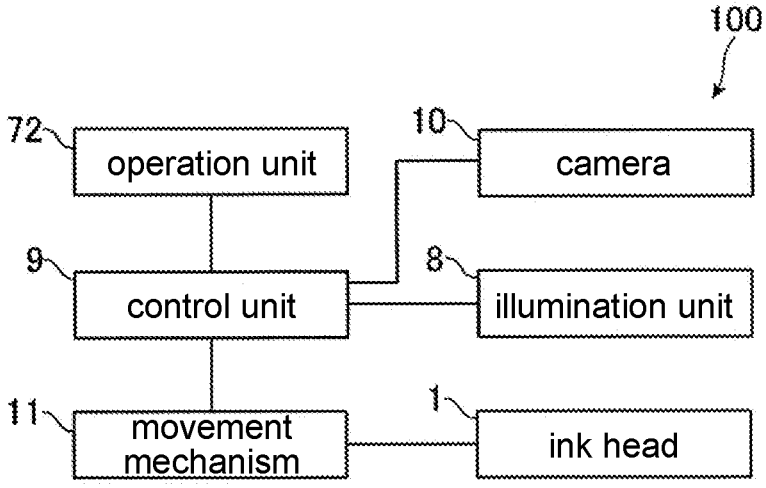
FIG. 7 is a block diagram illustrating a control configuration of the printer according to the third embodiment.

Next, the third embodiment is described with reference to FIGS. 6 and 7. Unlike the first embodiment in which the window portion 71 is arranged at the upper portion of the housing 7 so that visual recognition can be performed, the third embodiment is configured to be capable of capturing images by arranging a camera 10 instead of the window portion 71, as illustrated in FIG. 6. Moreover, the camera 10 is an example of an "imaging unit" in the claims.

In the third embodiment, the camera 10 is disposed at a position at which the window portion 71 of the first embodiment is disposed. That is, the camera 10 is disposed at a position at which the positional reference 3 and the top surface and the lateral surface of the fingernail 200 being the printing target can be imaged simultaneously from above. An image of the top surface and the lateral surface of the fingernail 200 imaged simultaneously by the camera 10 is transmitted to the control unit 9. Moreover, FIG. 7 is a block diagram illustrating a control configuration of the printer 100 according to the third embodiment.

The control unit 9 detects a shape of a nail and a position of the nail based on the captured image. Further, the control unit 9 performs correction process on image data such as adjustment of printing size based on the detected shape and position of the nail. Then, the control unit 9 controls printing (controls the ink head 1 and the movement mechanism 11) in accordance with the image data subjected to the correction process.

In addition, data of the captured image is transmitted via wireless or wired communication to a display device which is separately arranged from the printer 100, or an instrument connected to the display device. For example, the data is transmitted to a display, a smartphone, a personal computer, or the like. Consequently, the user can check, by the display device, the image captured by the camera 10. The user can perform the position adjustment of the fingernail 200 in the up-down direction (Z direction) and the horizontal direction (XY direction) according to the image displayed on the display device.

Moreover, other configurations of the third embodiment are the same as those of the first embodiment.

Effects of Third Embodiment

In the third embodiment, the following effects can be achieved.

In the third embodiment, similar to the first embodiment, the first mirror 4 (first reflection member) is arranged which is disposed at the lateral position separated from the placement unit 2 toward the lateral side so that the position of the first mirror in the up-down direction (Z direction) overlaps the positional reference 3 and the fingernail 200 (printing target) in a lateral view. The first mirror 4 reflects light arriving at the first mirror from the lateral surface of the fingernail 200 and the positional reference 3, and the upper end of the reflective surface which reflects light is positioned above the positional reference 3 and the lower end of the reflective surface is positioned below the positional reference 3. Consequently, the position adjustment of the fingernail 200 being the printing target in the horizontal direction (XY direction) and the up-down direction (Z direction) can be easily performed.

In addition, in the third embodiment, as described above, the top surface and the lateral surface of the fingernail 200 (printing target) and the positional reference 3 can be imaged simultaneously from above. Consequently, the position adjustment of the fingernail 200 in the up-down direction (Z direction) and the horizontal direction (XY direction) can be performed by imaging the fingernail from above. As a result, compared with a case in which the cameras 10 are arranged at both the upper side and the lateral side to the position adjustment in the up-down direction (Z direction) and the horizontal direction (XY direction), the number of components can be suppressed from increasing and apparatus configuration can be suppressed from being complicated.

In addition, in the third embodiment, as described above, the camera 10 is arranged which is configured to be capable of imaging the top surface and the lateral surface of the fingernail 200 (printing target) and the positional reference 3 from above. Consequently, the position and the shape of the fingernail 200 can be accurately grasped by performing the imaging process or the like on a captured image. As a result, the position adjustment of the fingernail 200 in the horizontal direction and the up-down direction can be easily performed, and printing accuracy can be improved.

Moreover, other effects of the third embodiment are the same as those of the first embodiment.

Fourth Embodiment

Next, the fourth embodiment is described with reference to FIG. 8. Unlike the first embodiment configured to be capable of visually recognizing the top surface and the lateral surface of the fingernail 200 (printing target) and the positional reference 3 from above, the fourth embodiment is configured to be capable of visually recognizing the top surface and the lateral surface of the fingernail 200 and the positional reference 3 from the lateral side.

Figure 8:
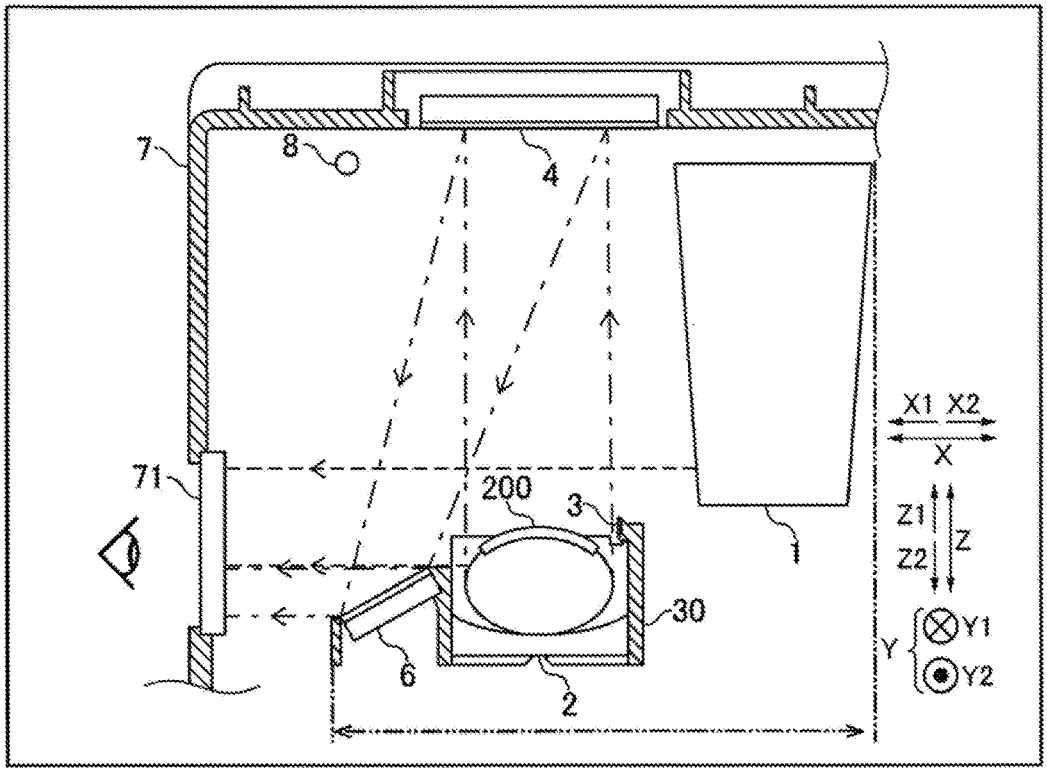
FIG. 8 is a view illustrating arrangement of a first mirror and a third mirror inside a printer according to a fourth embodiment.

In the fourth embodiment, as illustrated in FIG. 8, the first mirror 4 is a mirror that reflects the light arriving from the top surface of the fingernail 200 placed at the placement unit 2, as illustrated by a dashed line in FIG. 8. That is, the reflective surface of the first mirror 4 is disposed to face downward. The first mirror 4 is disposed at an upper position separated from the placement unit 2 toward an upper side so that the position of the first mirror in the horizontal direction (XY direction) overlaps the fingernail 200 in a plan view. In addition, the first mirror 4 is disposed directly above the fingernail 200 being the printing target above the upper end of the ink head 1. Consequently, an error due to parallax is unlikely to occur during the position adjustment in the horizontal direction (XY direction).

The third mirror 6 is a mirror that reflects, toward the window portion 71 at the lateral side, the light reflected from the first mirror 4 as illustrated by a dashed line in FIG. 8. That is, the reflective surface of the third mirror 6 is disposed to face the side of the reflective surface of the first mirror 4. Moreover, the third mirror 6 is an example of a "third reflection member" in the claims. The third mirror 6 is disposed at a position below the positional reference 3 in the up-down direction (Z direction). In addition, the third mirror 6 is disposed at a position between the first mirror 4 and the window portion 71, and this position is separated from the placement unit 2 toward the lateral side in the horizontal direction (XY direction).

The first mirror 4 and the third mirror 6 may be configured to be movable or be configured to be detachable for maintenance. In addition, in order to adjust a visual difference in size due to a difference in optical path length between the side view of the fingernail 200 being the printing target and a top view of the fingernail projected on the mirror, the first mirror 4 and the third mirror 6 may be magnifying mirrors.

The window portion 71 is arranged at a lateral side of the housing 7. The window portion 71 is arranged at a position at which the positional reference and the lateral surface of the fingernail 200 being the printing target are visually recognizable from right in front (right beside) and at which the reflective surface of the third mirror 6 is visually recognizable. In addition, a magnifying lens may be disposed at a portion of the window portion 71 to which the light reflected from the third mirror 6 is incident. When the magnifying lens is disposed, it is possible to adjust a visual difference due to a difference in optical path length between the top view of the fingernail 200 which is projected on the reflective surface of the mirror and the side view of the fingernail 200 and the positional reference 3.

By disposing the first mirror 4 and the third mirror 6 as described above, the top surface of the fingernail 200 being the printing target and the lateral surface of the fingernail 200 and the positional reference 3 can be visually recognized simultaneously from the lateral side. In addition, similar to the first embodiment, the marker 21 arranged at the placement unit 2 and the marker 31 arranged at the restriction member 30 can also be visually recognized simultaneously. Consequently, it is also possible to simultaneously check the marker 21 and the marker 31 used for performing the position adjustment in the horizontal direction (XY direction) and the positional reference 3 being the reference used for performing the position adjustment in the up-down direction (Z direction) simply by visual recognition from the lateral side. As a result, the position adjustment of the fingernail 200 being the printing target in the up-down direction (Z direction) and the horizontal direction (XY direction) can be performed simply by the visual recognition from the lateral side.

Moreover, other configurations of the fourth embodiment are the same as those of the first embodiment.

Effects of Fourth Embodiment

In the fourth embodiment, the following effects can be achieved.

In the fourth embodiment, as described above, the first mirror 4 (first reflection member) is arranged which is disposed at the upper position separated from the placement unit 2 toward the upper side so that the position of the first mirror in the horizontal direction (XY direction) overlaps the fingernail 200 (printing target) in a plan view, the first mirror 4 reflecting light arriving at the first mirror from the top surface of the fingernail 200. Consequently, by disposing the first mirror 4 at the upper position, the first mirror 4 reflects light arriving from the top surface of the fingernail 200, and thus the top surface of the fingernail 200 can be visually recognized or imaged from a direction of reflection. In addition, by disposing the first mirror 4 at the upper position, the first mirror 4 is not disposed at a lateral side of the fingernail 200, and thus the lateral surface of the fingernail 200 and the positional reference can be visually recognized or imaged from the lateral side. As a result, the light arriving at the first mirror from the top surface of the fingernail 200 is reflected to be laterally guided, and thereby the top surface and the lateral surface of the fingernail 200 can be visually recognized or imaged simultaneously from the lateral side. In addition, by disposing the first mirror 4 at the upper position, the first mirror 4 is not disposed at the lateral side of the fingernail 200, the lateral surface of the fingernail 200 and the positional reference can be visually recognized or imaged from right in front (right beside). Hence, an error due to parallax is unlikely to occur with respect to the positional reference, and the position adjustment can be easily performed. Consequently, when the first mirror 4 is arranged at the upper position, the position adjustment of the fingernail 200 in the horizontal direction (XY direction) and the up-down direction (Z direction) can be easily performed.

In addition, in the fourth embodiment, as described above, the first mirror 4 (first reflection member) is disposed at the upper position, and the position of the first mirror in the up-down direction (Z direction) is disposed at a position above the upper end of the ink head 1. Consequently, the first mirror 4 can be disposed directly above the fingernail 200, and thus an error due to parallax is unlikely to occur during the position adjustment in the horizontal direction (XY direction). As a result, the position adjustment can be more easily performed.

In addition, in the fourth embodiment, as described above, the position of the first mirror 4 (first reflection member) in the up-down direction (Z direction) is arranged at the position below the positional reference 3 and at the position separated from the placement unit 2 toward the lateral side, and the third mirror 6 (third reflection member) that laterally reflects the light reflected from the first mirror 4 is arranged. Consequently, the third mirror 6 is not limited by the arrangement of the ink head 1. Hence, compared with the first mirror 4, the third mirror 6 can be close to the fingernail 200, and thus the top surface of the fingernail 200 can be visually recognized at a position closer to the fingernail 200. As a result, the top surface and the lateral surface of the fingernail 200 and the positional reference can be visually recognized or imaged simultaneously at a smaller viewing angle, and thus the position adjustment can be more easily performed.

In addition, in the fourth embodiment, as described above, the first mirror 4 (first reflection member) is disposed at the upper position, and the top surface and the lateral surface of the fingernail 200 (printing target) and the positional reference 3 can be visually recognized from the lateral side. Consequently, the position adjustment of the fingernail 200 in the up-down direction (Z direction) and the horizontal direction (XY direction) can be performed by the visual recognition from the lateral side. As a result, in the position adjustment in the up-down direction (Z direction) and the horizontal direction (XY direction), a procedure (work burden) for the position adjustment can be suppressed from increasing compared with a case in which the top surface and the lateral surface of the fingernail 200 and the positional reference are visually recognized from both the upper side and the lateral side to perform the position adjustment.

In addition, in the fourth embodiment, as described above, the printer includes the housing 7 that covers the ink head 1, the placement unit 2, the positional reference 3, and the first mirror 4 (first reflection member), the illumination unit 8 that is arranged in the housing 7 and irradiates the fingernail 200 (printing target) with the illumination light, and the control unit 9 that controls on and off of the illumination light of the illumination unit 8 based on operations for performing the printing on the fingernail 200. Consequently, the user can turn on the illumination light when the selection of a printing image and a printing size is completed and the printer comes into a state in which the position adjustment of the fingernail 200 can be performed. Hence, when the illumination light is turned on, the illumination light leaks out of the hole of the housing 7, the hole being arranged for the finger to be inserted therethrough. As a result, since it is possible for the user to easily recognize that the printer comes into a state in which insertion and the position adjustment of the finger can be performed, the insertion and the position adjustment of the finger can be guided, and operability can be improved.

In addition, in the fourth embodiment, as described above, the printing target to which light is reflected from the first mirror 4 (first reflection member) is the fingernail 200. According to this configuration, a nail printer can be provided in which the position adjustment of the fingernail 200 in the horizontal direction (XY direction) and the up-down direction (Z direction) can be easily performed through visual recognition of the fingernail from above.

Fifth Embodiment

Next, a fifth embodiment is described with reference to FIG. 9. Unlike the fourth embodiment in which the third mirror 6 (third reflection member) is arranged, in the fifth embodiment, the light arriving from the upper surface of the fingernail 200 is laterally reflected by the first mirror 4 (first reflection member) but not by the third mirror 6 (third reflection member).

Figure 9:
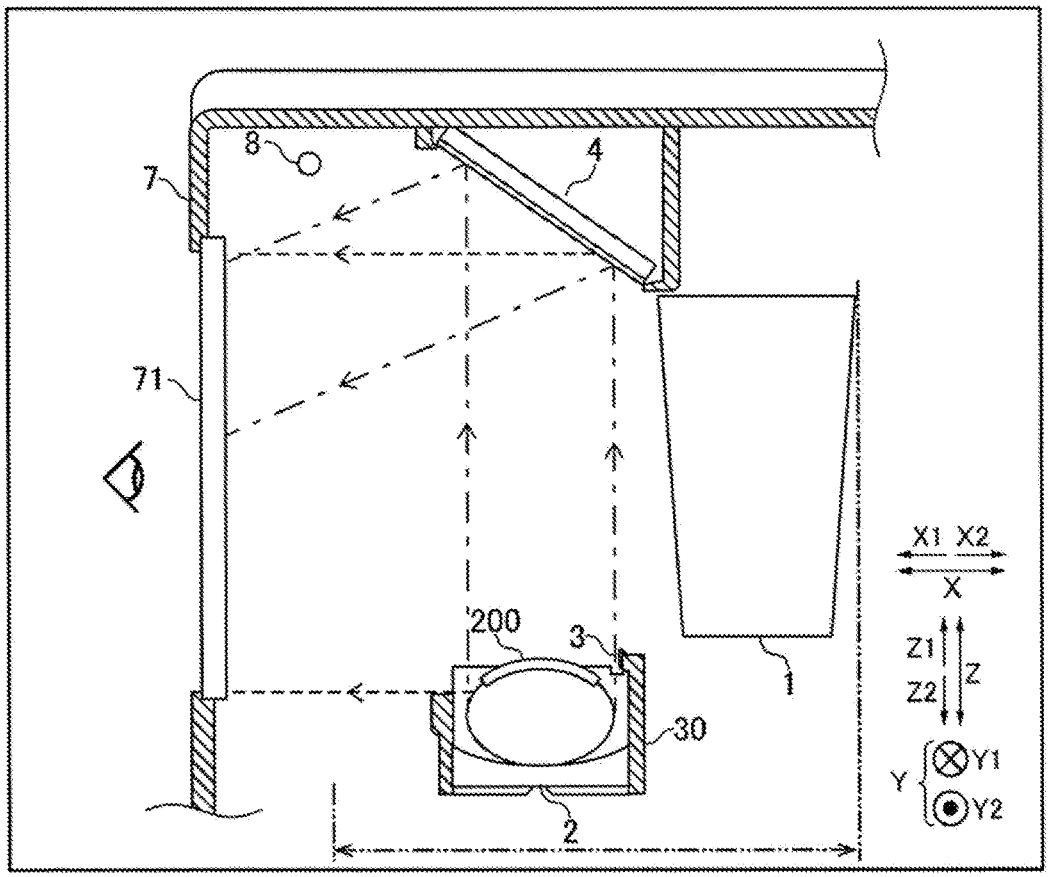
FIG. 9 is a view illustrating arrangement of a first mirror inside a printer according to a fifth embodiment.

In the fifth embodiment, as illustrated in FIG. 9, the first mirror 4 laterally reflects the light arriving from the upper surface of the fingernail 200. In addition, the window portion 71 may be configured to be widened in the Z direction so that the light reflected by the first mirror 4 can be visually recognized.

Effects of Fifth Embodiment the fifth embodiment, the following effects can be achieved.

In the fifth embodiment, similar to the fourth embodiment, the first mirror 4 (first reflection member) is arranged which is disposed at the upper position separated from the placement unit 2 toward the upper side so that the position of the first mirror in the horizontal direction (XY direction) overlaps the fingernail 200 (printing target) in a plan view, the first mirror 4 reflecting the light arriving at the first mirror from the top surface of the fingernail 200. Consequently, the position adjustment of the fingernail 200 being the printing target in the horizontal direction (XY direction) and the up-down direction (Z direction) can be easily performed.

In the fifth embodiment, as described above, the light arriving from the upper surface of the fingernail 200 is laterally reflected by the first mirror 4 (first reflection member) but not by the third mirror 6 (third reflection member). Consequently, compared with a case in which the third mirror 6 (third reflection member) is arranged, the number of components can be suppressed from increasing, and apparatus configuration can be suppressed from being complicated.

Moreover, other effects of the fifth embodiment are the same as those of the fourth embodiment.

Sixth Embodiment

Next, the sixth embodiment is described with reference to FIG. 10. Unlike the fourth embodiment in which the window portion 71 is arranged at the lateral surface of the housing 7 so that visual recognition can be performed, the sixth embodiment is configured to be capable of capturing image by arranging the camera 10 instead of the window portion 71.

Figure 10:
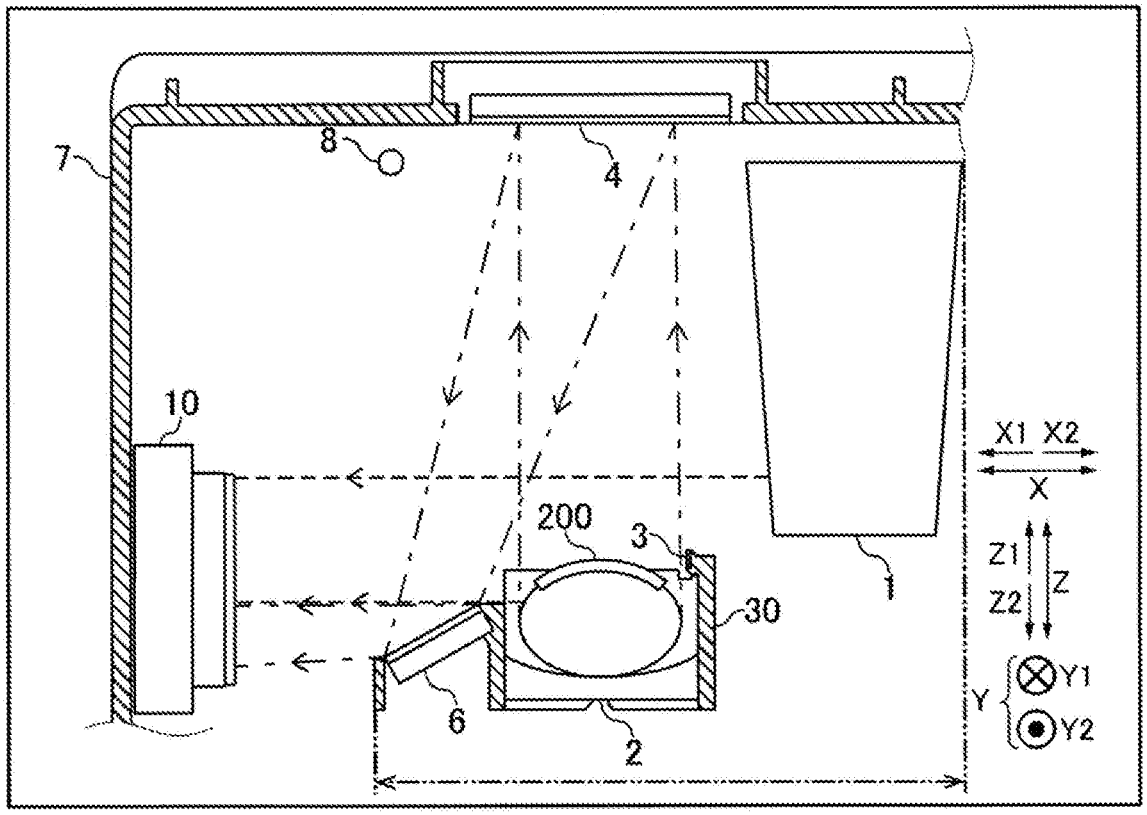
FIG. 10 is a view illustrating arrangement of a first mirror, a third mirror, and a camera inside a printer according to a sixth embodiment.

In the sixth embodiment, as illustrated in FIG. 10, the camera 10 is disposed at a position at which the window portion 71 of the fourth embodiment is disposed. That is, the camera 10 is disposed at a position at which the top surface and the lateral surface of the fingernail 200 being the printing target can be imaged simultaneously from the lateral side. The image of the top surface and the lateral surface of the fingernail 200 captured simultaneously by the camera 10 is transmitted to the control unit 9.

The control unit 9 detects a shape of a nail and a position of the nail based on the captured image. Further, the control unit 9 performs correction process on image data such as adjustment of printing size based on the detected shape and position of the nail. Then, the control unit 9 controls printing (controls the ink head 1 and the movement mechanism 11) in accordance with the image data subjected to the correction process.

In addition, data of the captured image is transmitted via wireless or wired communication to a display device which is separately arranged from the printer 100, or an instrument connected to the display device. For example, the data is transmitted to a display, a smartphone, a personal computer, or the like. Consequently, the user can check, by the display device, the image captured by the camera 10. The user can perform the position adjustment of the fingernail 200 in the up-down direction (Z direction) and the horizontal direction (XY direction) by the image displayed on the display device.

Moreover, other configurations of the sixth embodiment are the same as those of the fourth embodiment.

Effects of Sixth Embodiment

In the sixth embodiment, the following effects can be achieved.

In the sixth embodiment, similar to the fourth embodiment, the first mirror 4 (first reflection member) is arranged which is disposed at the upper position separated from the placement unit 2 toward the upper side so that the position of the first mirror in the horizontal direction (XY direction) overlaps the fingernail 200 (printing target) in a plan view, the first mirror 4 reflecting the light arriving at the first mirror from the top surface of the fingernail 200. Consequently, the position adjustment of the fingernail 200 being the printing target in the horizontal direction (XY direction) and the up-down direction (Z direction) can be easily performed.

In addition, in the sixth embodiment, as described above, the top surface and the lateral surface of the fingernail 200 (printing target) and the positional reference 3 can be imaged from above. Consequently, the position adjustment of the fingernail 200 in the up-down direction (Z direction) and the horizontal direction (XY direction) can be performed by capturing images from the lateral side. As a result, compared with a case in which the cameras 10 are arranged at both the upper side and the lateral side to perform the position adjustment in the up-down direction (Z direction) and the horizontal direction (XY direction), the number of components can be suppressed from increasing, and apparatus configuration can be suppressed from being complicated.

In addition, in the sixth embodiment, as described above, the camera 10 is arranged which is configured to be capable of imaging the top surface and the lateral surface of the fingernail 200 (printing target) and the positional reference from the lateral side. Consequently, the position and the shape of the fingernail 200 can be accurately grasped by performing the imaging process or the like on the captured image. As a result, the position adjustment of the fingernail 200 in the horizontal direction and the up-down direction can be easily performed, and printing accuracy can be improved.

Moreover, other effects of the sixth embodiment are the same as those of the fourth embodiment.

VARIATION EXAMPLES

Moreover, the embodiments disclosed herein should be considered as being illustrative rather than limitative in all respects. The scope of the disclosure is not represented by the description of the above-described embodiments but is represented by the claims, and further includes meanings equivalent to the scope of the claims and all modifications (variation example) within the scope.

For example, in the first to sixth embodiments, an example of the configuration in which the ink head 1 is movable in the horizontal direction (XY direction) is described; however, the disclosure is not limited hereto. In some exemplary embodiments of the disclosure, the ink head 1 may be configured to be movable in the up-down direction in addition to the horizontal direction.

In addition, in the first to third embodiments, an example is described in which the first reflection member (first mirror 4) is configured to be disposed in a direction (X direction) intersecting an insertion direction (Y direction) of the finger with respect to the placement unit 2. However, the disclosure is not limited hereto. In some exemplary embodiments of the disclosure, the first reflection member may be disposed at a tip side (Y direction) of the finger. In this case, the positional reference is disposed at an opposite side of a tip of the finger.

In addition, in the first to third embodiments, an example is described in which the second reflection member (second mirror 5) is configured to be disposed in a direction intersecting the insertion direction of the finger with respect to the placement unit 2 is described; however, the disclosure is not limited hereto. In some exemplary embodiments of the disclosure, the second reflection member may be disposed at the tip side of the finger.

In addition, in the first to sixth embodiments, an example in which a mirror is used as the first reflection member (first mirror 4) is described; however, the disclosure is not limited hereto. In some exemplary embodiments of the disclosure, the first reflection member is a member that reflects light and may be configured of a prism or the like.

In addition, in the first to third embodiments, an example in which a mirror is used as the second reflection member (second mirror 5) is described; however, the disclosure is not limited hereto. In some exemplary embodiments of the disclosure, the second reflection member is a member that reflects light and may be configured of a prism or the like.

In addition, in the fourth to sixth embodiments, an example in which a mirror is used as the third reflection member (third mirror 6) is described; however, the disclosure is not limited hereto. In some exemplary embodiments of the disclosure, the third reflection member is a member that reflects light and may be configured of a prism or the like.

Figure 11:
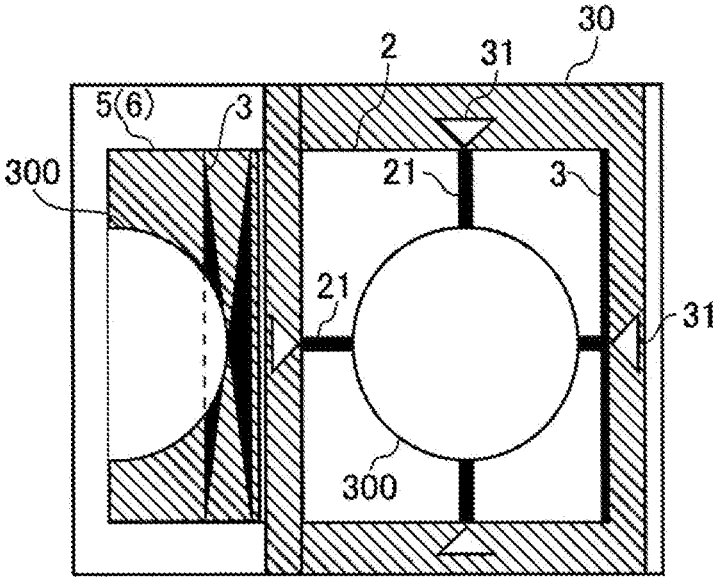
FIG. 11 illustrates an example of a top surface and a lateral surface of a fingernail and a positional reference which are visually recognized from a window portion of the printer according to a first variation example of the first embodiment to the sixth embodiment.

In addition, in the first embodiment, an example in which the positional reference 3 is one reference line is described; however, the disclosure is not limited hereto. In some exemplary embodiments of the disclosure, a mark as illustrated in FIG. 11 may be used as the positional reference. In some exemplary embodiments of the disclosure, the positional reference may be formed by a line, a figure, a mark, and a combination thereof, or concavities and convexities may be arranged to form the positional reference by a three-dimensional shape.

In addition, in the first to sixth embodiments, an example in which the printing target is the fingernail 200 is described; however, the disclosure is not limited hereto. In some exemplary embodiments of the disclosure, as illustrated in FIG. 11, an object such as a ball 300 may be set as the printing target. In this case, a movement mechanism configured of a motor or the like may be further arranged at the placement unit 2, and thereby the placement unit is configured to be movable, and movement of the placement unit and the position adjustment of the printing target are performed by an operation of the operation unit.

In addition, in the first to sixth embodiments, an example in which the operation unit 72 is configured of the physical button is described; however, the disclosure is not limited hereto. In some exemplary embodiments of the disclosure, the operation unit 72 may be configured of a touch panel or the like.

Figure 12:
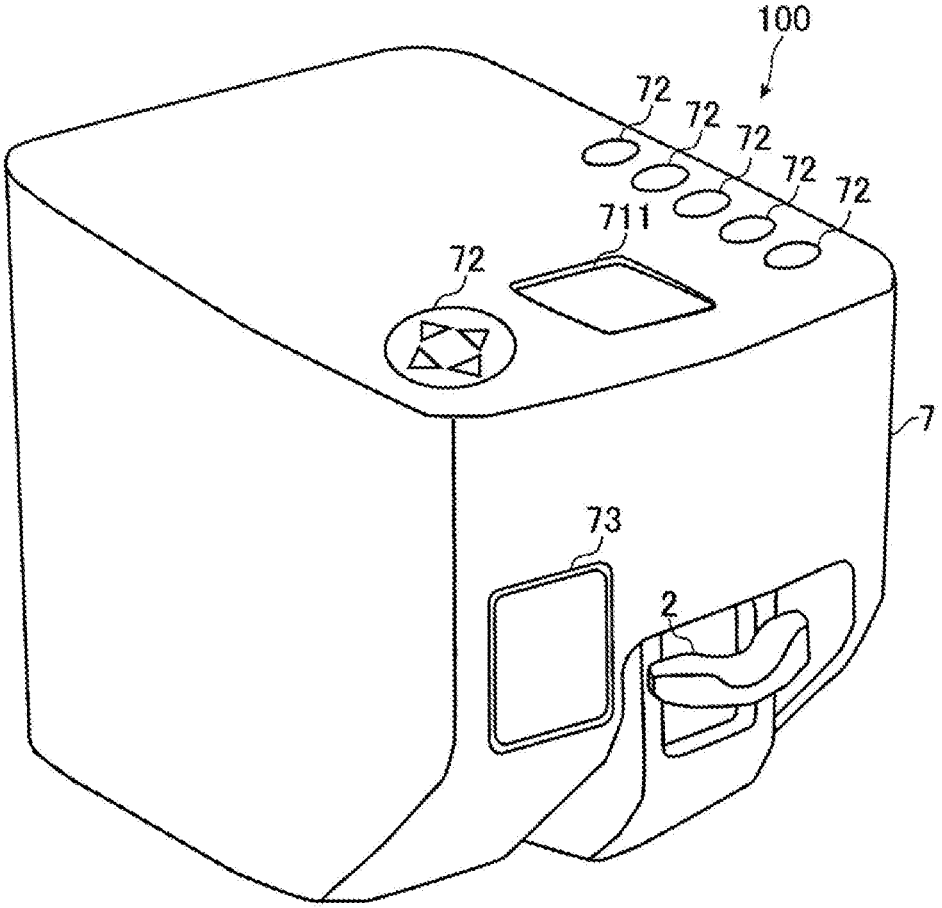
FIG. 12 is an external view of a printer according to a second variation example of a third embodiment.

In addition, in the first to sixth embodiments, an example of the configuration in which a display unit such as a display is not arranged in a main body of the printer 100 is described; however, the disclosure is not limited hereto. In some exemplary embodiments of the disclosure, as illustrated in FIG. 12, a display unit 711 such as a display may be arranged so that an image captured by the imaging unit may be displayed on the display unit 711, or an image and a design to be printed and information thereof may be displayed on the display unit 711.

Other Configurations

According to one embodiment of the disclosure, a printer is provided to include: an ink head that is configured to be movable in a horizontal direction and applies ink on a printing target; a placement unit at which the printing target is placed; a positional reference that is arranged near the placement unit and is used as a reference for performing position adjustment of the printing target in an up-down direction; and a first reflection member configured to be disposed at a lateral position separated from the placement unit toward a lateral side so that a position of the first reflection member in the up-down direction overlaps the positional reference and the printing target in a lateral view, wherein the first reflection member reflects light arriving from a lateral surface of the printing target and the positional reference, and an upper end of a reflective surface which reflects light is positioned above the positional reference and a lower end is positioned below the positional reference, or the first reflection member configured to be disposed at an upper position separated from the placement unit toward an upper side so that a position of the first reflection member in the horizontal direction overlaps the printing target in a plan view, wherein the first reflection member reflects light arriving from a top surface of the printing target.

In the printer according to the disclosure, when the first reflection member is arranged which is disposed at the lateral position separated from the placement unit toward the lateral side so that the position of the first reflection member in the up-down direction overlaps the positional reference and the printing target in a lateral view, the first reflection member reflecting light arriving from the lateral surface of the printing target and the positional reference, and the upper end of the reflective surface which reflects light being positioned above the positional reference and the lower end being positioned below the positional reference, by disposing the first reflection member at the lateral position, the first reflection member reflects the light arriving from the lateral surface of the printing target and the positional reference. Hence, the lateral surface of the printing target and the positional reference can be visually recognized or imaged from a direction of reflection. In addition, by disposing the first reflection member at the lateral position, the first reflection member is not disposed above the printing target, and thus the top surface of the printing target can be visually recognized or imaged from above. As a result, the light arriving from the lateral surface of the printing target and the positional reference is reflected to be upwardly guided, and thereby the top surface and the lateral surface of the printing target can be visually recognized or imaged simultaneously from above. In addition, the first reflection member is disposed so that the position in the up-down direction overlaps the positional reference and the printing target in a lateral view, and thereby the positional reference can be visually recognized or imaged from right in front (right beside). Hence, an error due to parallax is unlikely to occur with respect to the positional reference, and the position adjustment can be easily performed. In addition, the upper end of the reflective surface of the first reflection member that reflects light is positioned above the positional reference, the lower end of the reflective surface is positioned below the positional reference, and thereby a range in which it is possible to perform visual recognition or imaging by the first reflection member can be widened in the up-down direction with the positional reference interposed in the range, and thus the printing target can be visually recognized or imaged easily even when the printing target is placed at a position that does not overlap the positional reference. Consequently, when the first reflection member is arranged at the lateral position, the position adjustment of the printing target in the horizontal direction and the up-down direction can be easily performed.

In addition, when the first reflection member is arranged which is disposed at the upper position separated from the placement unit toward the upper side so that the position of the first reflection member in the horizontal direction overlaps the printing target in a plan view, the first reflection member reflecting light arriving from the top surface of the printing target, by disposing the first reflection member at the upper position, the first reflection member reflects the light arriving from the top surface of the printing target. Hence, the top surface of the printing target can be visually recognized or imaged from a direction of reflection. In addition, by disposing the first reflection member at the upper position, the first reflection member is not disposed at a lateral side of the printing target, and thus the lateral surface of the printing target and the positional reference can be visually recognized or imaged from the lateral side. As a result, the light arriving from the top surface of the printing target is reflected to be laterally guided, and thereby the top surface and the lateral surface of the printing target can be visually recognized or imaged simultaneously from the lateral side. In addition, by disposing the first reflection member at the upper position, the first reflection member is not disposed at the lateral side of the printing target, and the lateral surface of the printing target and the positional reference can be visually recognized or imaged from right in front (right beside). Hence, an error due to parallax is unlikely to occur with respect to the positional reference, and the position adjustment can be easily performed. Consequently, when the first reflection member is arranged at the upper position, the position adjustment of the printing target in the horizontal direction and the up-down direction can be easily performed.

According to one embodiment, in the printer, when the first reflection member is disposed at the lateral position, the first reflection member may be disposed at a position that does not overlap a region in which the ink head is movable in a plan view. In this configuration, a size of the first reflection member is not limited by a position of a lower end of the ink head, and the size of the first reflection member can be increased. Hence, a range in which the printing target and the positional reference are simultaneously projected is widened. As a result, a range in which it is possible to compare the position of the printing target and the position of the positional reference is widened, and thus the position adjustment can be more easily performed.

The printer according to the aspect may further include a second reflection member that is disposed at a position below the positional reference and a position separated from the placement unit toward the lateral side and that upwardly reflects light reflected from the first reflection member, when the first reflection member is disposed at the lateral position. In this configuration, the second reflection member is not limited by arrangement of the ink head, and thus the second reflection member can be closer to the printing target than the first reflection member can be. Consequently, the lateral surface of the printing target and the positional reference can be visually recognized or imaged at a position closer to the printing target. As a result, the top surface and the lateral surface of the printing target and the positional reference can be visually recognized or imaged simultaneously at a smaller viewing angle, and thus the position adjustment can be more easily performed.

According to one embodiment, in the printer, when the first reflection member is disposed at the lateral position, the top surface and the lateral surface of the printing target and the positional reference may be configured to be visually recognized or imaged from above. In this configuration, when the top surface and the lateral surface of the printing target and the positional reference can be recognized from above, the printing target can be visually recognized from above, thereby performing position adjustment of the printing target in the up-down direction and the horizontal direction. As a result, compared with a case in which the top surface and the lateral surface of the printing target and the positional reference are visually recognized from both the upper side and the lateral side in the position adjustment in the up-down direction and the horizontal direction, a procedure (work burden) for the position adjustment can be suppressed from increasing. In addition, when the top surface and the lateral surface of the printing target and the positional reference can be imaged from above, the position adjustment of the printing target in the up-down direction and the horizontal direction can be performed by arranging an imaging unit at the upper side. As a result, compared with a case in which imaging units are arranged at both the upper side and the lateral side to perform the position adjustment in the up-down direction and the horizontal direction, the number of components can be suppressed from increasing, and apparatus configuration can be suppressed from being complicated.

According to one embodiment, in the printer, when the first reflection member is disposed at the upper position, the position of the first reflection member in the up-down direction may be disposed at a position above an upper end of the ink head. In this configuration, the first reflection member can be disposed directly above the printing target, and thus an error due to parallax is unlikely to occur during the position adjustment in the horizontal direction. As a result, the position adjustment can be more easily performed.

The printer according to the aspect may further include a third reflection member that is disposed at a position below the positional reference in the up-down direction and a position separated from the placement unit toward the lateral side and that laterally reflects light reflected from the first reflection member, when the first reflection member is disposed at the upper position. In this configuration, the third reflection member is not limited by arrangement of the ink head, and thus the third reflection member can be closer to the printing target than the first reflection member can be. Consequently, the top surface of the printing target can be visually recognized or imaged at a position closer to the printing target. As a result, the top surface and the lateral surface of the printing target and the positional reference can be visually recognized or imaged simultaneously at a smaller viewing angle, and thus the position adjustment can be more easily performed.

According to one embodiment, in the printer, when the first reflection member is disposed at the upper position, the top surface and the lateral surface of the printing target and the positional reference may be configured to be visually recognized or imaged from the lateral side. When the top surface and the lateral surface of the printing target and the positional reference can be visually recognized from the lateral side, it is possible to visually recognize the printing target from the lateral side, thereby performing position adjustment of the printing target in the up-down direction and the horizontal direction. As a result, compared with a case in which the top surface and the lateral surface of the printing target and the positional reference are visually recognized from both the upper side and the lateral side in the position adjustment in the up-down direction and the horizontal direction, a procedure (work burden) for the position adjustment can be suppressed from increasing. In addition, when the top surface and the lateral surface of the printing target and the positional reference can be imaged from the lateral side, the position adjustment of the printing target in the up-down direction and the horizontal direction can be performed by arranging an imaging unit at the lateral side. As a result, compared with a case in which imaging units are arranged at both the upper side and the lateral side to perform the position adjustment in the up-down direction and the horizontal direction, the number of components can be suppressed from increasing, and apparatus configuration can be suppressed from being complicated.

The printer according to the aspect may further include: a housing that covers the ink head, the placement unit, the positional reference, and the first reflection member; an illumination unit that is arranged in the housing and irradiates the printing target with illumination light; and a control unit that controls on and off of the illumination light of the illumination unit based on operations for performing printing on the printing target. In this configuration, through operations by a user, it is possible to switch between on and off of the illumination light. For example, when the printer is configured to turn on the illumination light in a case that the user performs an operation for selecting an image to be printed and the printer comes into a state in which the position adjustment of the printing target can be performed, a state of the printer can be shown by turning on and off the illumination light. Consequently, the user can easily check that the printer comes into the state in which the position adjustment of the printing target can be performed, and thus the user can guide placement and position adjustment of the printing target. As a result, operability can be improved.

The printer according to the aspect may further include an imaging unit that is configured to be capable of imaging the top surface and the lateral surface of the printing target and the positional reference from above, or that is configured to be capable of imaging the top surface and the lateral surface of the printing target and the positional reference from the lateral side. In this configuration, imaging process or the like is performed on a captured image, and thereby a position and a shape of the printing target can be accurately grasped. As a result, the position adjustment of the printing target in the horizontal direction and the up-down direction can be easily performed, and printing accuracy can be improved.

In the printer according to the aspect, the printing target to which light is reflected by the first reflection member may be a fingernail. In this configuration, a nail printer can be provided in which the position adjustment of the fingernail in the horizontal direction and the up-down direction can be easily performed.

According to the exemplary embodiments of the disclosure, as described above, it is possible to provide a printer in which position adjustment of a printing target in a horizontal direction and an up-down direction can be easily performed.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A printer, comprising:

a housing;

an ink head that is configured to be movable in a horizontal direction and applies ink on a printing target;

a placement unit on which the printing target is placed;

a positional reference that is arranged near the placement unit and is used as a reference for performing position adjustment of the printing target in an up-down direction; and a first reflection member for visually recognizing the printing target, configured to be disposed at a lateral position of the housing separated from the placement unit toward a lateral side so that a position of the first reflection member in the up-down direction overlaps the positional reference and the printing target in a lateral view, wherein the first reflection member reflects light arriving from a lateral surface of the printing target and the positional reference, and an upper end of a reflective surface which reflects light is positioned above the positional reference and a lower end of the reflective surface is positioned below the positional reference, or the first reflection member for visually recognizing the printing target, being configured to be disposed at an upper position of the housing separated from the placement unit toward an upper side so that a position of the first reflection member in the horizontal direction overlaps the printing target in a plan view, wherein the first reflection member reflects light arriving from a top surface of the printing target, wherein the housing covers the ink head, the placement unit, the positional reference, and the first reflection member.

2. The printer according to claim 1, wherein when the first reflection member is disposed at the lateral position, the first reflection member is disposed at a position that does not overlap a region in which the ink head is movable in a plan view.

3. The printer according to claim 1, further comprising a second reflection member that is disposed at a position below the positional reference and a position separated from the placement unit toward the lateral side and upwardly reflects light reflected from the first reflection member, when the first reflection member is disposed at the lateral position.

4. The printer according to claim 2, further comprising a second reflection member that is disposed at a position below the positional reference and a position separated from the placement unit toward the lateral side and upwardly reflects light reflected from the first reflection member, when the first reflection member is disposed at the lateral position.

5. The printer according to claim 1, wherein when the first reflection member is disposed at the lateral position, the top surface and the lateral surface of the printing target and the positional reference are configured to be visually recognized from above through a window portion that is arranged on an upper side of the housing or imaged from above by an imaging unit arranged on the upper side of the housing.

6. The printer according to claim 2, wherein when the first reflection member is disposed at the lateral position, the top surface and the lateral surface of the printing target and the positional reference are configured to be visually recognized from above through a window portion that is arranged on an upper side of the housing or imaged from above by an imaging unit arranged on the upper side of the housing.

7. The printer according to claim 3, wherein when the first reflection member is disposed at the lateral position, the top surface and the lateral surface of the printing target and the positional reference are configured to be visually recognized from above through a window portion that is arranged on an upper side of the housing or imaged from above by an imaging unit arranged on the upper side of the housing.

8. The printer according to claim 4, wherein when the first reflection member is disposed at the lateral position, the top surface and the lateral surface of the printing target and the positional reference are configured to be visually recognized or imaged from above.

9. The printer according to claim 1, wherein when the first reflection member is disposed at the upper position, the position of the first reflection member in the up-down direction is disposed at a position above an upper end of the ink head.

10. The printer according to claim 1, further comprising a third reflection member that is disposed at a position below the positional reference in the up-down direction and a position separated from the placement unit toward the lateral side and that laterally reflects light reflected from the first reflection member, when the first reflection member is disposed at the upper position.

11. The printer according to claim 5, further comprising a third reflection member that is disposed at a position below the positional reference in the up-down direction and a position separated from the placement unit toward the lateral side and that laterally reflects light reflected from the first reflection member, when the first reflection member is disposed at the upper position.

12. The printer according to claim 9, wherein when the first reflection member is disposed at the upper position, the top surface and the lateral surface of the printing target and the positional reference are configured to be visually recognized from the lateral side through a window portion that is arranged on the lateral side of the housing or imaged from the lateral side by an imaging unit arranged on the lateral side of the housing.

13. The printer according to claim 10, wherein when the first reflection member is disposed at the upper position, the top surface and the lateral surface of the printing target and the positional reference are configured to be visually recognized from the lateral side through a window portion that is arranged on the lateral side of the housing or imaged from the lateral side by an imaging unit arranged on the upper side of the housing.

14. The printer according to claim 11, wherein when the first reflection member is disposed at the upper position, the top surface and the lateral surface of the printing target and the positional reference are configured to be visually recognized from the lateral side through a window portion that is arranged on the lateral side of the housing or imaged from the lateral side by an imaging unit arranged on the upper side of the housing.

15. The printer according to claim 1, further comprising:

an illumination unit that is arranged in the housing and irradiates the printing target with illumination light; and a control unit that controls on and off of the illumination light of the illumination unit based on operations for performing printing on the printing target.

16. The printer according to claim 2, further comprising:

an illumination unit that is arranged in the housing and irradiates the printing target with illumination light; and a control unit that controls on and off of the illumination light of the illumination unit based on operations for performing printing on the printing target.

17. The printer according to claim 1, further comprising an imaging unit that is arranged on an upper side of the housing and is configured to be capable of imaging the top surface and the lateral surface of the printing target and the positional reference from above, or that is arranged on a lateral side of the housing and is configured to be capable of imaging the top surface and the lateral surface of the printing target and the positional reference from the lateral side.

18. The printer according to claim 2, further comprising an imaging unit that is arranged on an upper side of the housing and is configured to be capable of imaging the top surface and the lateral surface of the printing target and the positional reference from above, or that is arranged on a lateral side of the housing and is configured to be capable of imaging the top surface and the lateral surface of the printing target and the positional reference from the lateral side.

19. The printer according to claim 1,
wherein the printing target to which light is reflected by the first reflection member is a fingernail.

20. The printer according to claim 2,
wherein the printing target to which light is reflected by the first reflection member is a fingernail.

* * * * *